US010251000B2

(12) United States Patent
Hong et al.

(10) Patent No.: US 10,251,000 B2
(45) Date of Patent: Apr. 2, 2019

(54) HEARING ASSISTANT DEVICE FOR INFORMING ABOUT STATE OF WEARER

(71) Applicant: EM-TECH. Co., Ltd., Busan (KR)

(72) Inventors: Choong Sheek Hong, Gyeonggi-do (KR); Dong Sung Kim, Gyeonggi-do (KR); Yong Jun Kwon, Gyeonggi-do (KR); Taek Jin Han, Gyeonggi-do (KR)

(73) Assignee: EM-TECH. Co., Ltd., Busan (KR)

( * ) Notice: Subject to any disclaimer, the term of this patent is extended or adjusted under 35 U.S.C. 154(b) by 0 days.

(21) Appl. No.: 15/640,859

(22) Filed: Jul. 3, 2017

(65) Prior Publication Data

US 2018/0007475 A1 Jan. 4, 2018

(30) Foreign Application Priority Data

Jul. 4, 2016 (KR) ..... 10-2016-0084383

(51) Int. Cl.
*H01R 25/00* (2006.01)
*H04R 25/00* (2006.01)
(Continued)

(52) U.S. Cl.
CPC ..... *H04R 25/30* (2013.01); *G10L 25/21* (2013.01); *G10L 25/78* (2013.01); *H04R 25/43* (2013.01);
(Continued)

(58) Field of Classification Search
CPC .. H04R 1/1091; H04R 1/1041; H04R 1/1016; H04R 1/1083; H04R 3/005; H04R 5/033;
(Continued)

(56) References Cited

U.S. PATENT DOCUMENTS

2001/0046304 A1* 11/2001 Rast ..... H04R 1/1041 381/74
2002/0007270 A1* 1/2002 Murashima ..... G10L 25/78 704/215
2014/0126733 A1* 5/2014 Gauger, Jr. ..... G10K 11/178 381/71.6

FOREIGN PATENT DOCUMENTS

JP 2000286736 A 10/2000
JP 2011097268 A 5/2011
(Continued)

*Primary Examiner* — Leshui Zhang
(74) *Attorney, Agent, or Firm* — Murphy, Bilak & Homiller, PLLC

(57) ABSTRACT

A hearing assistance device for informing about the state of a wearer includes: an input part configured to receive a selection input for either an ambient listening function or a music listening function; at least one microphone configured to pick up ambient sound; a speaker configured to send the ambient sound to the wearer; a communication part configured to perform wired or wireless communication with an external electronic communication device; an indication part configured to indicate that the ambient listening function or the music listening function is being performed; and a controller configured to perform the ambient listening function to pick up ambient sound from the microphone according to a selection input from the input part and send the ambient sound to the speaker, or perform the music listening function to play stored music or music received from the communication part and send the music to the speaker.

5 Claims, 2 Drawing Sheets

(51) Int. Cl.

| | |
|---|---|
| ***G10L 25/21*** | (2013.01) |
| ***G10L 25/78*** | (2013.01) |
| ***H04R 29/00*** | (2006.01) |

(52) U.S. Cl.

CPC ..... *H04R 25/554* (2013.01); *H04R 29/00* (2013.01); *G10L 2025/786* (2013.01); *H04R 2225/41* (2013.01); *H04R 2225/43* (2013.01); *H04R 2225/61* (2013.01)

(58) Field of Classification Search

CPC ..... H04R 2201/107; H04R 2201/109; H04R 2400/01; H04R 2420/07; H04R 2499/11; H04R 1/10; G10L 21/0208; G10L 2021/02087; H04S 1/005; H04M 1/6041; H04M 1/6058; H04M 1/6066; H04M 1/05; H04M 2250/02; H04B 1/385; H04B 1/05; H04B 1/6058; H04B 1/6066

USPC ..... 381/74, 73.1, 309, 312–322, 328, 107, 381/110, 58–60; 455/569.1, 569.2, 570, 455/575.2; 700/94

See application file for complete search history.

(56) References Cited

FOREIGN PATENT DOCUMENTS

| | | | |
|---|---|---|---|
| JP | 2013165493 | A | 8/2013 |
| JP | 2015144337 | A | 8/2015 |
| KR | 1020110010186 | A | 2/2011 |

* cited by examiner

HEARING ASSISTANT DEVICE FOR INFORMING ABOUT STATE OF WEARER

PRIORITY CLAIM

The present application claims priority to Korean Patent Application No. 10-2016-0084383 filed on 4 Jul. 2016, the content of said application incorporated herein by reference in its entirety.

TECHNICAL FIELD

The present invention relates to a hearing assistance device, and more particularly, to a hearing assistance device for informing about the state of a wearer, which provides an ambient listening function and a music listening function and lets a speaking person know that the wearer can listen to their voice through the ambient listening function when the ambient listening function is performed.

BACKGROUND

Generally, people with hearing loss refer to those who cannot hear well enough to understand speech in normal everyday situations—that is, hearing-impaired people. Hearing loss can be categorized as mild, moderate, moderate-severe, severe, etc. according to severity.

There are several types of hearing loss: conductive hearing loss, sensorineural hearing loss, and mixed hearing loss. Hearing loss has multiple causes, including damage to the external ear canal, perforation of the eardrum, disruption of the ossicles, otitis externa, otitis media, ageing, congenital problems, genetics, exposure to noise, hyperthermia, medications, etc., which may be classified by the damage to the bone conduction and air conduction.

Hearing-impaired people face difficulties in hearing in everyday situations, and therefore, they need a hearing aid to compensate for hearing loss well enough. The hearing aid is a device that amplifies a speaking person's voice or ambient sound to help a person with hearing loss hear speech clearly and give them a natural experience of hearing.

Generally, a hearing aid includes a transmitter that collects a speaking person's voice or ambient sound and outputs it as an electrical signal, an amplifier that receives the signal output from the transmitter and rectifies and amplifies it, a receiver that converts the signal amplified by the amplifier into a sound wave and sends it to the ear of a person with hearing loss, and a battery that supplies electric power to the transmitter, receiver, and amplifier. There are many types of hearing aids, including box-type aids, behind-the-ear aids, eyeglass aids, in-the-ear aids, and, more recently, completely-in-the-canal aids, an enhanced version of the in-the-ear type, which are placed deep in the ear canal.

With conventional hearing aids, however, there is no way for the wearer to indicate that they can conduct a conversation as they hear voice from their surroundings by activating an ambient listening function on their hearing aid.

Example of efforts in this regard include the following: Korean Patent Publication No. 10-2011-010186.

SUMMARY

An object of the present invention is to provide a hearing assistance device for informing about the state of a wearer, which provides an ambient listening function and a music listening function and lets a speaking person know that the wearer can listen to their voice through the ambient listening function when the ambient listening function is performed.

According to an aspect of the present invention, there is provided a hearing assistance device for informing about the state of a wearer, including: an input part that receives a selection input for either an ambient listening function or a music listening function; at least one microphone that picks up ambient sound; a speaker that sends the ambient sound to the wearer; a communication part that performs wired or wireless communication with an external electronic communication device; an indication part that indicates that the ambient listening function or the music listening function is being performed; and a controller that performs the ambient listening function to pick up ambient sound from the microphone according to a selection input from the input part and send the ambient sound to the speaker, or that performs the music listening function to play stored music or music received from the communication part and send the music to the speaker.

In some embodiments, the controller checks whether the picked-up ambient sound contains human voice, and, if so, indicates through the indication part that the human voice is being sent through the speaker.

In some embodiments, the controller picks up ambient sound frame-by-frame, calculates the power for a reference number of N frames, calculates the reference power for an Nth frame based on the calculated power for the N frames, and when the power for (N+1)th and subsequent frames is higher than the calculated reference power, determines that the ambient sound contains human voice and indicates through the indication part that the human voice is being sent through the speaker.

In some embodiments, the controller calculates the reference power for the second frame by the following equation: reference power for second frame=$\lambda\times$(power for first frame)+$(1-\lambda)\times$(power for second frame), wherein $\lambda$ is a forgetting factor ranging between 0 and 1.

In some embodiments, the controller calculates the reference power for the Nth frame by the following equation: reference power for Nth frame=$\lambda\times$(reference power for (N−1)th frame)+$(1-\lambda)\times$(power for Nth frame), wherein N is between 3 and the reference number.

In some embodiments; the controller determines whether the reference power for the Nth frame needs to be updated, and if so, performs an update by the following equation: reference power for Nth frame=$\lambda\times$(reference power for (N−1)th frame)+$(1-\lambda)\times$(power for Nth frame), wherein N is equal to or greater than (reference number+1), and $\lambda$ is a forgetting factor ranging between 0 and 1.

In some embodiments, when the power for the (N+1)th and subsequent frames is lower than the reference power for the Nth frame, the controller updates the reference power for the Nth frame.

In some embodiments, when the power for the (N+1)th and subsequent frames is higher than the calculated reference power, the controller stores the accumulated number, and, if the accumulated number is equal to or greater than a reference accumulated number, determines that the ambient sound contains human voice.

In some embodiments, the controller calculates the power and reference power for each frame in each preset critical band.

The present invention has the advantage of providing an ambient listening function and a music listening function and letting a speaking person know that the wearer can listen to their voice through the ambient listening function when the ambient listening function is performed.

Those skilled in the art will recognize additional features and advantages upon reading the following detailed description, and upon viewing the accompanying drawings.

DETAILED DESCRIPTION

Hereinafter, a hearing assistance device for informing about the state of a wearer according to an exemplary embodiment of the present invention will be described in detail with reference to the accompanying drawings.

Figure 1:
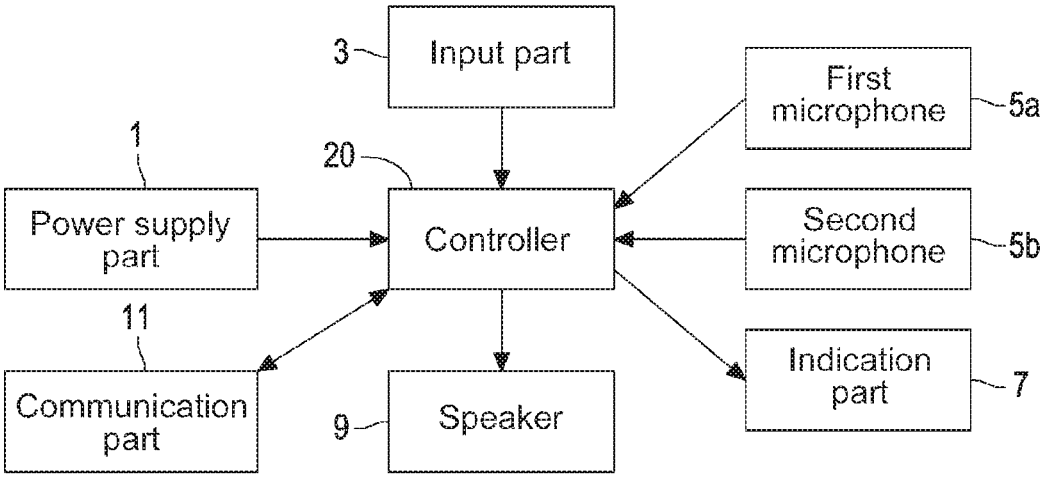
FIG. 1 is a block diagram of a hearing assistance device for informing about the state of a wearer according to the present invention.

FIG. 1 is a block diagram of a hearing assistance device for informing about the state of a wearer according to the present invention. The hearing assistance device according to the present invention includes a power supply part 1 that supplies required power, an input part 3 that receives a power on/off input and a selection input for either an ambient listening function or a music listening function or an input for conversion between the two functions, first and second microphones 5*a* and 5*b* for picking up ambient sound (voice or audio); an indication part 7 that indicates a power on/off state and which function (ambient listening and music listening) is currently being performed, a speaker 9 that emits sound such as voice or music, a communication part 11 that performs wired and/or wireless communication (e.g., Bluetooth communication; etc.) with an external electronic communication device (e.g., a smartphone, pad, tablet PC, etc.), and a controller 20 that controls the above-mentioned components and performs either the ambient listening function or the music listening function according to a selection/conversion input from the input part 3. However, it should be apparent to those skilled in the art that the power supply part 1, the input part 3, the first and second microphones 5*a* and 5*b*, the indication part 7, the speaker 9, and the communication part 11 are well-known technologies, so detailed descriptions of them will be omitted.

The music listening mode will be described first. The controller 20 receives from the input part 3 a selection input for the music listening mode made by the wearer, and reads a saved audio file (e.g., mp3, mp4, etc.), converts it into an electrical audio signal using a stored playback application, and applies the electrical audio signal to the speaker 9 to deliver audio (music) so that the wearer can hear it. Moreover, the controller 20 indicates through the indication part 7 that the music listening mode is currently being performed. Alternatively, the controller 20 may receive an audio file from an external electronic communication device through the communication part 11, convert it into an electrical audio signal using a stored playback application, and apply the electrical audio signal to the speaker 9 to produce audio (music).

Next, the ambient listening mode will be described. The controller 20 receives from the input part 3 a selection input for the ambient listening mode made by the wearer, and operates at least one of the first and second microphones 5*a* and 5*b* to pick up ambient sound (voice and audio). In this case, the controller 20 indicates through the indication part 7 that the ambient listening mode is currently being performed. Moreover, the controller 20 checks whether the picked-up ambient sound contains human voice. In the following, a process in which the controller 20 checks whether the picked-up ambient sound contains human voice will be described in detail. Once it is found that the ambient sound contains human voice, the controller 20 indicates through the indication part 7 that human voice is being picked up. The controller 20 amplifies ambient sound with noise removed therefrom or processes it by a preset method, and sends it to the wearer's hearing organ through the speaker 9. With this indication, a speaking person conversing with the wearer can make sure that their voice is being sent to the wearer through the wearer's hearing assistance device.

Figure 2:
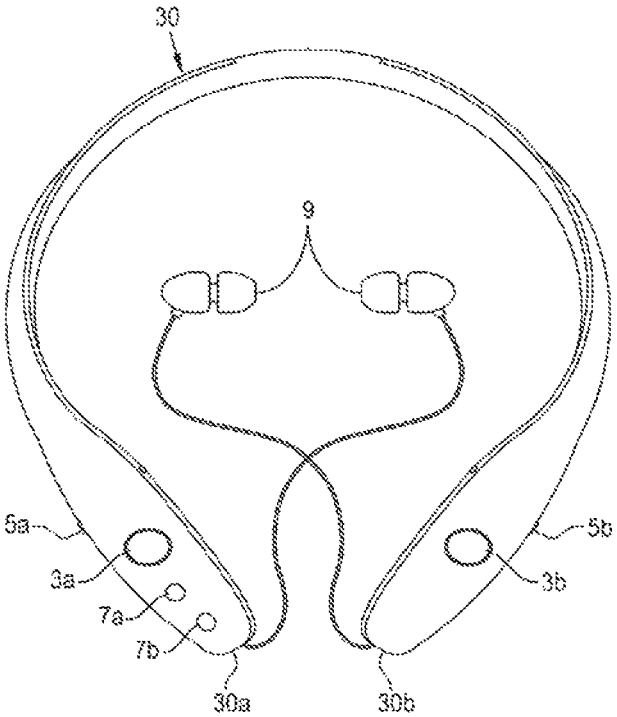
FIG. 2 is a perspective view of the hearing assistance device of FIG. 1.

FIG. 2 is a perspective view of the hearing assistance device of FIG. 1. The hearing assistance device includes a main body portion 30 with an opening between two opposite ends 30*a* and 30*b* that is placed around or on a human body, such as the wearer's neck or shoulder.

The input part 3 is provided on the main body portion 30 and consists of a power on/off input part 3*a* and a functional input part 3*b* for receiving a selection input for either the ambient listening function or the music listening function or an input for conversion between the two functions.

The first and second microphones 5*a* and 5*b* are provided to face outward so as to pick up ambient sound (audio and voice).

The indication part 7 includes a first indicator 7*a* that indicates that the ambient listening function or music listening function is being performed and a second indicator 7*b* that indicates that a picked-up ambient sound contains human voice. An indication on the second indicator 7*b* lets a speaking person know that they can converse with the wearer. Alternatively, the indication part 7 (the first indicator 7*a* and the second indicator 7*b*) may consist of one indicator that flashes in different colors (blue and red) or in different patterns.

The speaker 9 consists of a pair of speakers connected respectively to the two opposite ends 30*a* and 30*b* of the main body portion 30, which are inserted or placed in the wearer's ear to properly deliver music or voice.

Figure 3:
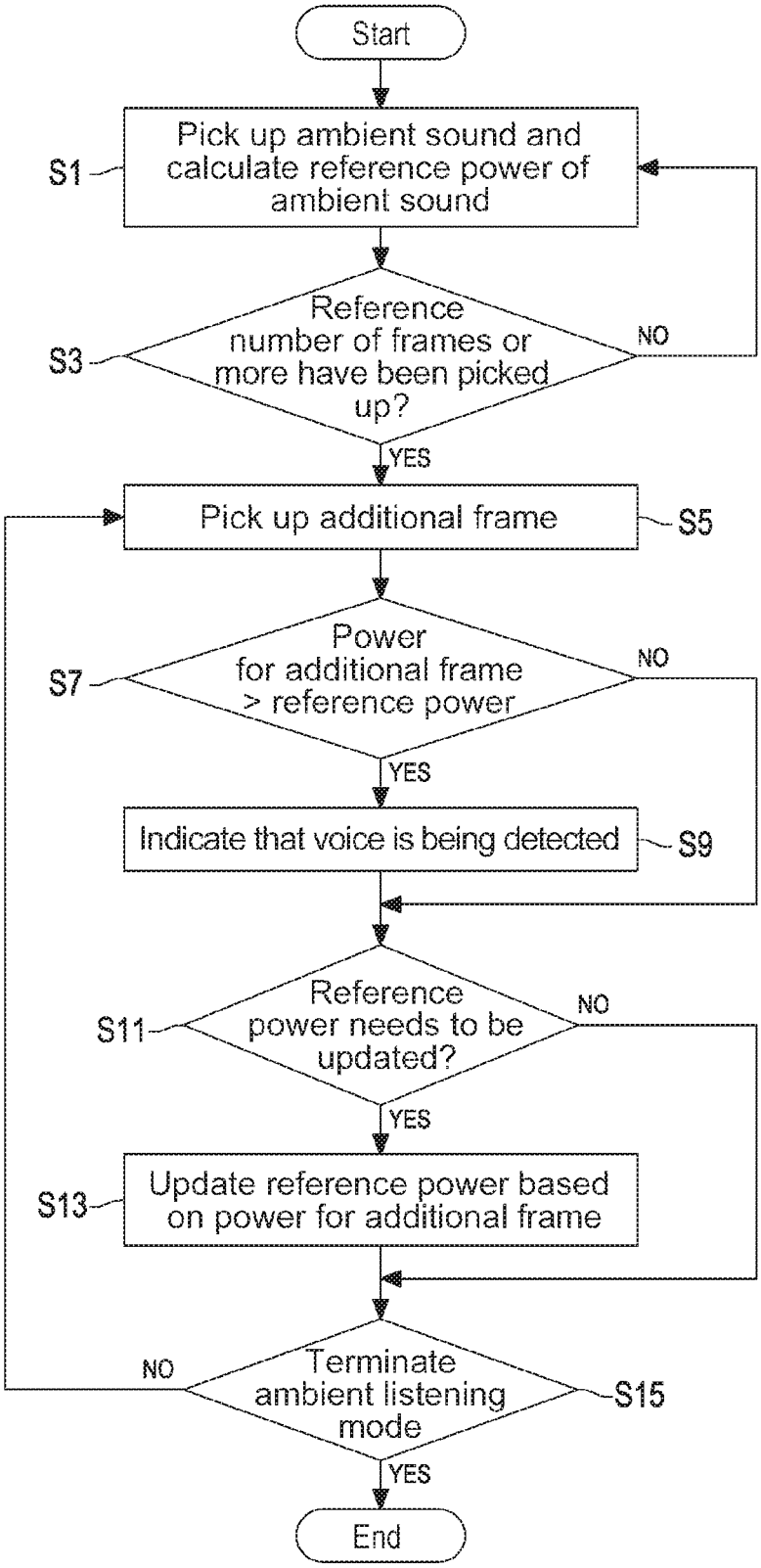
FIG. 3 is a flowchart of a method of detecting human voice by the hearing assistance device of FIG. 1.

FIG. 3 is a flowchart of a method of detecting human voice by the hearing assistance device of FIG. 1. The controller 20 receives from the input part 3 a selection input for the ambient listening mode made by the wearer and performs the ambient listening mode.

In step S1, the controller 20 picks up an ambient sound through the first and second microphones 5*a* and 5*b* and calculates the reference power of the ambient sound. The controller 20 picks up ambient sound frame-by-frame. Here, a frame is a period of time during which a plurality of samples is taken. For instance, for a sampling rate of 48,000, 1 sample may correspond to 1/48,000 seconds, 256 samples may correspond to 256/48,000 seconds, and 1 frame may be set to 256 samples.

Moreover, the controller 20 firstly calculates the power of an ambient sound for each of a reference number of frames in different critical bands, in order to calculate the reference power of the ambient sound. Each critical band is a group of frequencies as in the following Table 1:

TABLE 1

| Critical Band | Frequency Range (Hz) |
|---|---|
| 1 | 0 to below 100 |
| 2 | 100 to below 200 |

TABLE 1-continued

| Critical Band | Frequency Range (Hz) |
|---|---|
| 3 | 200 to below 300 |
| 4 | 300 to below 400 |
| 5 | 400 to below 510 |
| 6 | 510 to below 630 |
| 7 | 630 to below 770 |
| . | . |
| . | . |
| . | . |

For each frame, ambient sound is distinguished by first to Nth critical bands, as in Table 1, and the power in each critical band is calculated. For example, when performing a 128-point FFT on the ambient sound during one frame, the controller 20 creates 64 real number parts and 64 imaginary number parts and calculates 64 power levels by $(\text{real})^2+(\text{imag})^2$. Using the calculated 64 power levels, the controller 20 calculates the power in each critical band corresponding to each frequency range of Table 1. For example, when 64 bins constitute three critical bands, each consisting of 10 bins, 20 bins, and 34 bins, respectively, the power in these critical bands is calculated by (the sum of 10 power levels)/10, (the sum of 20 power levels)/20, and (the sum of 34 power levels)/34.

Moreover, the controller 20 calculates the reference power in each critical band based on the power for each frame. The reference power in all the critical bands is calculated in such a way that the reference power in a specific critical band is calculated based on the power for a reference number of frames in the specific critical band. First, the controller 20 performs an operation on the reference power for the previous frame(s) in a specific critical band and the power for the current frame in the same critical band, as in the following Equation 1, to set the reference power for the current frame, which corresponds to the reference number of frames.

$$\text{Reference power for } N\text{th frame} = \lambda\times(\text{reference power for } (N-1)\text{th frame}) + (1-\lambda)\times(\text{power for } N\text{th frame}) \quad \text{[Equation 1]}$$

wherein N is between 3 and 20, and λ is a forgetting factor used to avoid a rapid change of signal, ranging between 0 and 1. Equation 1 has the same effect as a low-pass filter.

The controller 20 calculates the reference power for the second frame by λ×(power for first frame)+(1−λ)×(power for second frame), and calculates the reference power for the third and subsequent frames as in Equation 1. The controller 20 sets the reference number of frames for calculating reference power to be 20 and calculates the reference power in each critical band. Here, the reference number may vary.

In step S3, the controller 20 determines whether the reference number of frames or more have been picked up. To pick up the reference number of frames or more and calculate the reference power, the controller 20 proceeds to step S1 if less than the reference number of frames have been picked up or proceeds to step S5 if the reference number of frames or more have been picked up.

In step S5, the controller 20 picks up an additional frame (the 21th frame or an (N+1)th frame), in addition to the reference number of frames and calculates the power for the additional frame.

In step S7, the controller 20 compares the power for the additional frame calculated in step S5 with the reference power for the reference number of frames (or the frames previous to the additional frame)—that is, the reference power for the 20th frame— calculated in step S1. If the power for the additional frame is higher than the reference power, then the controller 20 proceeds to step S9; otherwise, it proceeds to step S11.

In step S9, since the power for the additional frame is higher than the reference power, the controller 20 determines that the ambient sound contains human voice, emits the ambient sound corresponding to the additional frame through the speaker 9 to deliver the human voice, and indicates through the indication part 7 to let a speaking person know that the wearer is listening to their voice.

In step S11, the controller 20 determines whether the current calculated reference power needs to be updated. Especially when the power for the additional frame is lower than the current calculated reference power, the controller 20 may determine more accurately whether the ambient sound contains voice by updating the reference power based on the power for the additional frame and the current calculated reference power. When it is determined that the reference power needs to be updated—for example, the power for the additional frame is lower than the current calculated reference power, the controller 20 proceeds to step S13; otherwise, it proceeds to step S15.

In step S13, the controller 20 updates the reference power based on the power for the additional frame. The controller 20 performs an update on the reference power by the following Equation 2:

$$\text{Reference power for } N\text{th frame} = \lambda\times(\text{reference power for } (N-1)\text{th frame}) + (1-\lambda)\times(\text{power for } N\text{th frame}) \quad \text{[Equation 2]}$$

wherein N is 21 or greater, and λ is a forgetting factor used to avoid a rapid change of signal, ranging between 0 and 1.

In step S15, the controller 20 determines whether it has received an input for termination of the ambient listening mode from the input part 3. If the controller 20 has received an input for termination of the ambient listening mode, then it finishes the human voice detection; otherwise, it proceeds to step S5 to pick up an additional frame (e.g., the 22th frame) from the microphones 5*a* and 5*b* and to perform steps S5 to S13.

In the above-described step S7, the controller 20 performs the comparison of the power for the additional frame with the reference power, in each critical band. The following Table 2 shows examples of the power for the additional frame and the reference power according to critical bands.

TABLE 2

| | Reference Power | Power for Additional Frame | Change in Power | Update |
|---|---|---|---|---|
| First Critical Band | 10 | 20 | +10 | X |
| Second Critical Band | 20 | 10 | −10 | ○ |
| Third Critical Band | 30 | 20 | −10 | ○ |
| Fourth Critical Band | 40 | 50 | +10 | X |
| Fifth Critical Band | 50 | 60 | +10 | X |
| Sixth Critical Band | 60 | 70 | +10 | X |
| Seventh Critical Band | 70 | 80 | +10 | X |

In the above-described step S7, the controller 20 finds out that the power for the additional frame in the first, fourth, and seventh critical bands is higher than the reference power, based on the data of Table 2, and when the power for the additional frame is higher than the reference power in a reference number (e.g., 4) of critical bands, out of all the critical bands (7 in total), the controller 20 may determine that the ambient sound contains human voice and proceed to step S9.

In the above-described step S11, when the power for the additional frame is lower than the current calculated reference power, the controller 20 determines that an update is needed for the second and third critical bands and proceeds to step S13 to perform an update on the reference power in the second and third critical bands, based on the power for the additional frame.

Alternatively, in the above-described step S7, when the power for the additional frame is higher than the reference power, the controller 20 may increase the accumulated number of voice detections and proceed to step S11, rather than proceeding to step S9. If the accumulated number is equal to or greater than a reference accumulated number (e.g., 3), then the controller 20 may indicate, as in step S9, that the ambient sound contains human voice. Moreover, if the accumulated number reaches the reference accumulated number within a given period of time, then the controller 20 determines that the ambient sound contains human voice, and, as in step S9, sends the ambient sound corresponding to the additional frame through the speaker 9 to deliver human voice and indicates through the indication part 7 that the wearer is listening to the speaking person's voice. Alternatively, if the accumulated number does not reach the reference accumulated number, then the controller 20 may reset the accumulated number.

While this invention has been described in connection with what is presently considered to be practical exemplary embodiments, it is to be understood by those skilled in the art that the invention is not limited to the disclosed embodiments, but on the contrary, is intended to cover various modifications and equivalent arrangements included within the spirit and scope of the appended claims.

What is claimed is:

1. A hearing assistance device for informing about a state of a wearer of the hearing assistance device, the hearing assistance device comprising:

an input part configured to receive a selection input for either an ambient listening function or a music listening function;

at least one microphone configured to pick up ambient sound;

a speaker configured to send the ambient sound to the wearer;

a communication part configured to perform wired or wireless communication with an external electronic communication device;

an indication part configured to indicate that the ambient listening function or the music listening function is being performed; and a controller configured to perform the ambient listening function to pick up the ambient sound from the at least one microphone according to the selection input from the input part and send the ambient sound to the speaker, or perform the music listening function to play and send stored music or music received from the communication part to the speaker, wherein the controller is configured to check whether the ambient sound picked up from the at least one microphone contains human voice, and indicate through the indication part that the human voice is being sent through the speaker when the ambient sound contains human voice, wherein the controller is configured to pick up the ambient sound frame-by-frame, calculate a power in each critical band for a reference number of N frames, calculate a reference power in each critical band for an Nth frame based on the calculated power in each critical band for the N frames, calculate power in each critical band for an (N+1)th frame, compare the reference power and the power of the (N+1)th frame in each critical band and determine whether the ambient sound contains human voice according to the number of critical bands whose power is higher than the reference power in each critical band.

2. The hearing assistance device of claim 1, wherein the controller is configured to calculate the reference power for the second frame in each critical band by the following equation:

$$\text{reference power for second frame} = \lambda \times (\text{power for first frame}) + (1-\lambda) \times (\text{power for second frame}),$$

wherein $\lambda$ is a forgetting factor ranging between 0 and 1.

3. The hearing assistance device of claim 2, wherein the controller is configured to calculate the reference power for the Nth frame in each critical band by the following equation:

$$\text{reference power for the } N\text{th frame} = \lambda \times (\text{reference power for an } (N-1)\text{th frame}) + (1-\lambda) \times (\text{power for the } N\text{th frame}),$$

wherein N is between 3 and the reference number.

4. The hearing assistance device of claim 1, wherein the controller is configured to determine whether the reference power for the Nth frame in each critical band needs to be updated, and if so, perform an update by the following equation:

$$\text{reference power for the } N\text{th frame} = \lambda \times (\text{reference power for an } (N-1)\text{th frame}) + (1-\lambda) \times (\text{power for the } N\text{th frame}),$$

wherein N is equal to or greater than (reference number+1), and $\lambda$ is a forgetting factor ranging between 0 and 1.

5. The hearing assistance device of claim 4, wherein, when the power for the (N+1)th and subsequent frames is lower than the reference power for the Nth frame in a specific critical band, the controller is configured to update the reference power in the specific critical band for the Nth frame.

* * * * *